US008866808B2

(12) United States Patent
Li et al.

(10) Patent No.: US 8,866,808 B2
(45) Date of Patent: Oct. 21, 2014

(54) METHOD FOR DRIVING DISPLAY PANEL

(75) Inventors: Chung-Lung Li, Taipei (TW); Yun-Chung Lin, Changhua County (TW); Fang-Lin Chang, Taichung County (TW)

(73) Assignee: Au Optronics Corporation, Hsinchu (TW)

( * ) Notice: Subject to any disclaimer, the term of this patent is extended or adjusted under 35 U.S.C. 154(b) by 1676 days.

(21) Appl. No.: 12/356,545

(22) Filed: Jan. 21, 2009

(65) Prior Publication Data

US 2010/0141643 A1 Jun. 10, 2010

(30) Foreign Application Priority Data

Dec. 10, 2008 (TW) ..... 97148079 A

(51) Int. Cl.
*G09G 5/00* (2006.01)
*G09G 3/36* (2006.01)

(52) U.S. Cl.
CPC ..... *G09G 3/3648* (2013.01); *G09G 2320/0233* (2013.01); *G09G 2320/0219* (2013.01); *G09G 2310/0297* (2013.01); *G09G 2320/0285* (2013.01); *G09G 2310/067* (2013.01)
USPC ..... 345/214; 345/92; 345/82

(58) Field of Classification Search
USPC ..... 345/214, 92, 82
See application file for complete search history.

(56) References Cited

U.S. PATENT DOCUMENTS 6,075,507 A 6/2000 Miyahara et al.
7,221,352 B2 5/2007 Kodate et al.
7,852,302 B2 * 12/2010 Chiang et al. ..... 345/93
7,864,150 B2 * 1/2011 Shih ..... 345/94
2004/0263760 A1 12/2004 Kodate et al.
2007/0229427 A1 * 10/2007 Chen et al. ..... 345/92
2008/0049002 A1 * 2/2008 Lin et al. ..... 345/205
2008/0074404 A1 * 3/2008 Sashida ..... 345/204
2008/0129904 A1 * 6/2008 Kang et al. ..... 349/37
2008/0150868 A1 * 6/2008 Chen et al. ..... 345/95
2008/0225189 A1 * 9/2008 Yang et al. ..... 349/37
2008/0284769 A1 * 11/2008 Kumada et al. ..... 345/209
2009/0015527 A1 * 1/2009 Chung et al. ..... 345/87

FOREIGN PATENT DOCUMENTS

CN 1620682 5/2005
TW I224768 12/2004

OTHER PUBLICATIONS

1st Office Action of China counterpart application, issued on Jul. 24, 2009, p. 1-p. 5.
Office Action of Taiwan counterpart application issued on Dec. 27, 2012, p. 1-p. 6, in which the listed reference (TWI224768) was cited.

* cited by examiner

*Primary Examiner* — William Boddie
*Assistant Examiner* — Leonid Shapiro
(74) *Attorney, Agent, or Firm* — Jianq Chyun IP Office

(57) ABSTRACT

A method for driving a display panel is provided. The method includes the following steps. Firstly, providing a first scan signal to turn on a plurality of first sub-pixels within the $i^{th}$ pixel row of the display panel during a $N^{th}$ frame period, so as to make the first sub-pixels respectively receive a corresponding first data signal. Next, providing a second scan signal to turn on a plurality of second sub-pixels within the $i^{th}$ pixel row of the display panel during the $N^{th}$ frame period, so as to make the second sub-pixels respectively receive a corresponding second data signal. The amplitude of the first scan signal is different from the amplitude of the second scan signal, and N and i are positive integers.

9 Claims, 16 Drawing Sheets

METHOD FOR DRIVING DISPLAY PANEL

CROSS-REFERENCE TO RELATED APPLICATION

This application claims the priority benefit of Taiwan application serial no. 97148079, filed Dec. 10, 2008. The entirety of the above-mentioned patent application is hereby incorporated by reference herein and made a part of specification.

BACKGROUND OF THE INVENTION

1. Field of the Invention

The present invention relates to a flat panel technology, more particularly, to a driving method for promoting the display quality of the display panel.

2. Description of the Related Art

In the presence of all structures of the pixel array of the current LCD panel, one specie is so-called the half source driving (hereinafter "HSD") structure. The HSD structure would reduce the number of the data lines to half by which increasing the number of the scan lines to double. Since the number of the data lines is reduced to half, so that the number of the driving channels of the source driver would also be reduced to half. In addition, the arrangements of all of pixels in HSD structure's pixel array roughly could be divided into the delta arrangement, as shown in FIG. 1A, and the strip arrangement, as shown in FIG. 1B.

Even though the display panel adopting the HSD structure could be reduced the driving channels of the source driver to half, but since the amplitudes of the scan signals received by all odd pixels and all even pixels in the same pixel row in sequence are the same, and the timing difference for turning on all odd pixels and all even pixels in the same pixel row is the enabling time of one scan signal, such that the images displayed on the display panel would further be affected by the feed-through effect caused between the parasitic capacitors of each of pixels in the pixel array to produce an non-uniform luminance phenomenon, wherein such phenomenon is so-called the vertical blur phenomenon.

In general, the vertical blur phenomenon would produce that the luminance of all odd pixels in each pixel row of the display panel is higher than the luminance of all even pixels thereof, or the luminance of all even pixels in each pixel row of the display panel is higher than the luminance of all odd pixels thereof.

SUMMARY OF THE INVENTION

The present invention is directed to a driving method of a display panel for effectively improving the problem of images producing non-uniform luminance caused by the vertical blur phenomenon.

The present invention provides a driving method for a display panel. The driving method includes the following steps of providing a first scan signal to turn on a plurality of first sub-pixels in an $i^{th}$ pixel row of the display panel during a first period of an $N^{th}$ frame period, such that the first sub-pixels respectively and correspondingly receive a first data signal; and providing a second scan signal to turn on a plurality of second sub-pixels in the $i^{th}$ pixel row of the display panel during a second period of the $N^{th}$ frame period, such that the second sub-pixels respectively and correspondingly receive a second data signal. The amplitude of the first scan signal is different from the amplitude of the second scan signal, and N and i are a positive integer.

The driving method of the present invention provides the scan signals with different amplitude to the corresponding pixel row of the display panel, so as to improve the problem of images producing non-uniform luminance caused by the vertical blur phenomenon, and substantially promoting the display quality of the display panel.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE PREFERRED EMBODIMENTS

Reference will now be made in detail to the present preferred embodiments of the invention, examples of which are illustrated in the accompanying drawings.

Figure 2:
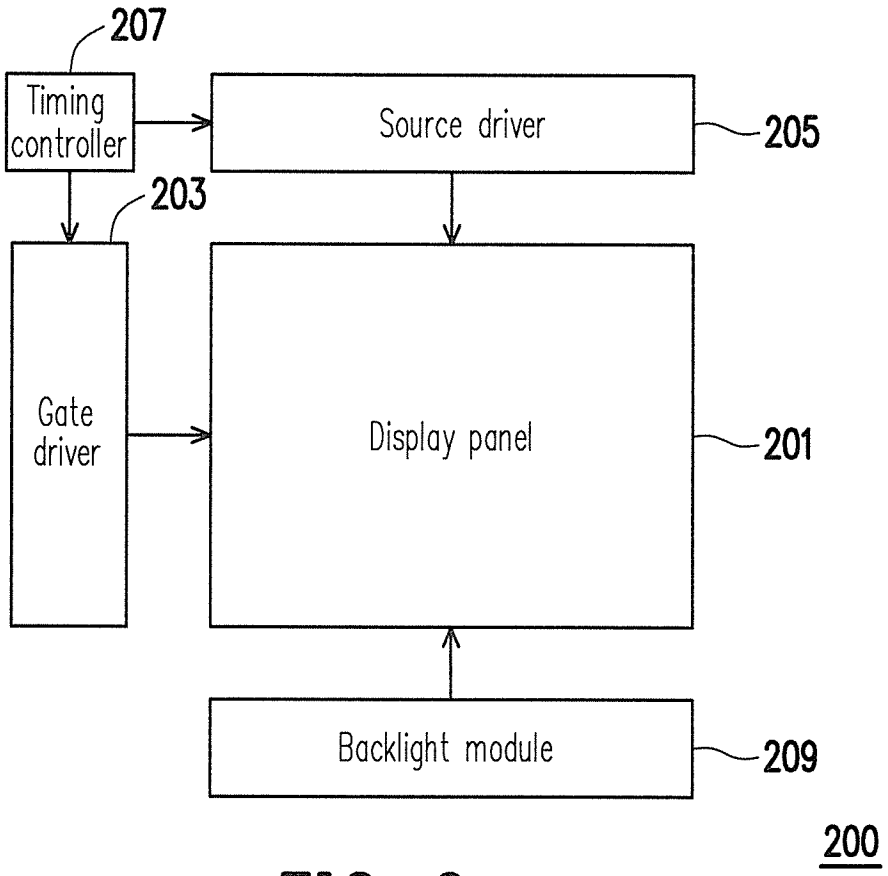
FIG. 2 is a system block diagram of a liquid crystal display according to an embodiment of the present invention.

FIG. 2 is a system block diagram of a liquid crystal display (LCD) 200 according to an embodiment of the present invention. Referring to FIG. 2, the LCD 200 includes a display panel 201, a gate driver 203, a source driver 205, a timing controller 207 and a backlight module 209. The gate driver 203 and the source driver 205 are controlled by the timing controller 207 for respectively providing scan signals and data signals to drive the display panel 201. The backlight module 209 is used for providing a light source to the display panel 201, such that the display panel 201 would achieve the purpose of displaying images.

Figure 1A:
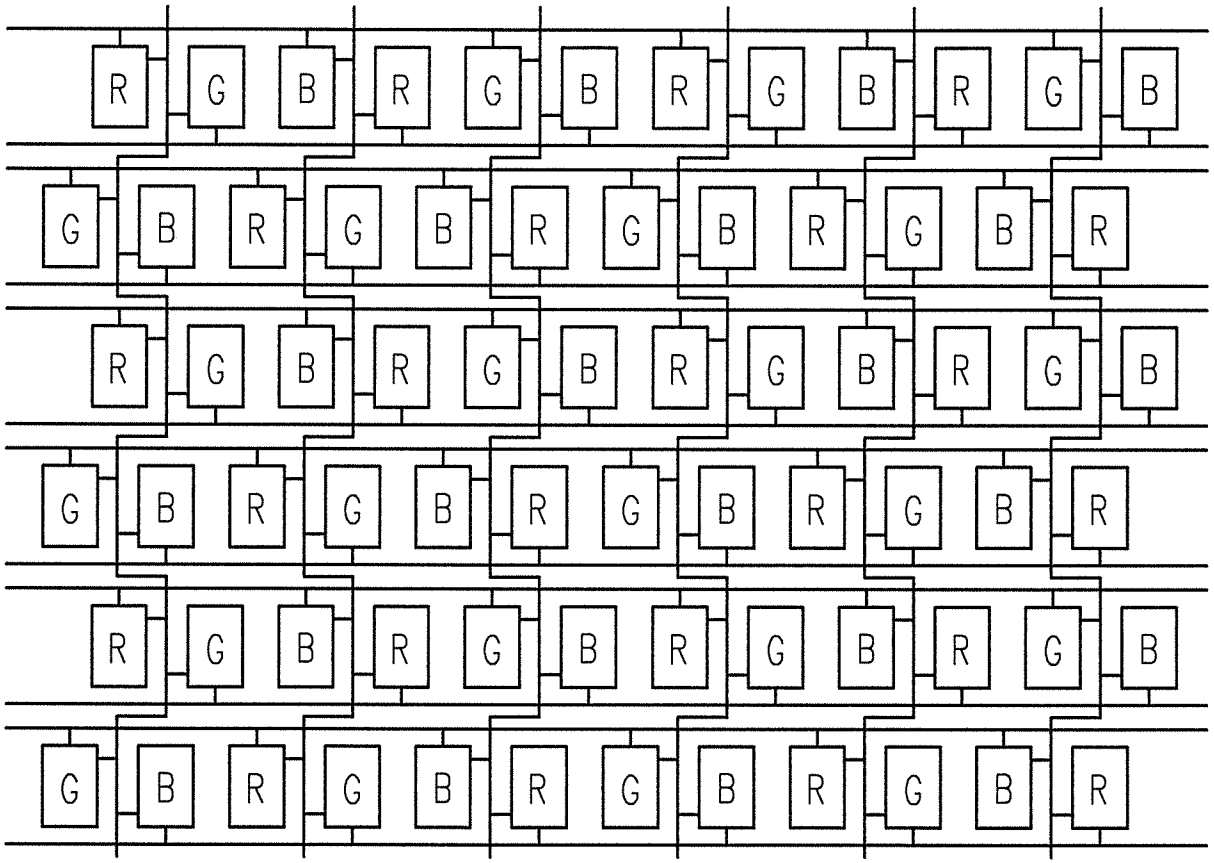
FIG. 1A(PRIOR ART)
FIG. 1A and FIG. 1B respectively show a diagram of the HSD structure in conventional.
Figure 1B:
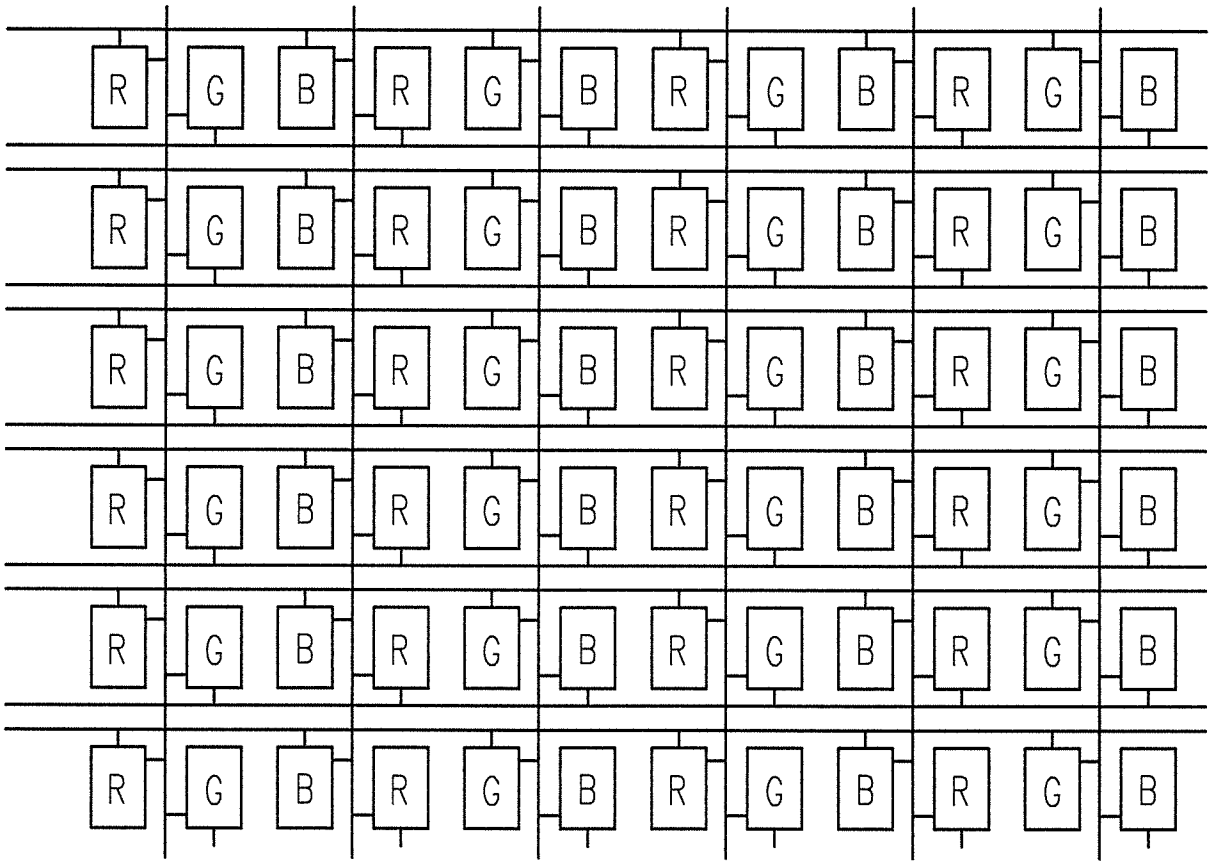
FIG. 1B(PRIOR ART)

In addition, the pixel array of the display panel 201 could be adopted the HSD structure such as FIG. 1A and FIG. 1B, but not limited thereto.

Even though the display panel adopting the HSD structure could be reduced the driving channels of the source driver to half, but since the amplitudes of the scan signals received by all odd pixels and all even pixels in the same pixel row in sequence are the same, and the timing difference for turning on all odd pixels and all even pixels in the same pixel row is the enabling time of one scan signal, such that the images displayed on the display panel would further be affected by the feed-through effect caused between the parasitic capacitors of each of pixels in the pixel array to produce an non-uniform luminance phenomenon, namely, the vertical blur phenomenon.

For effectively improving the problem of images producing non-uniform luminance caused by the vertical blur phenomenon. Below, a driving method for a display panel would be submitted by the present invention to improve the problem of images producing non-uniform luminance caused by the vertical blur phenomenon.

Figure 3:
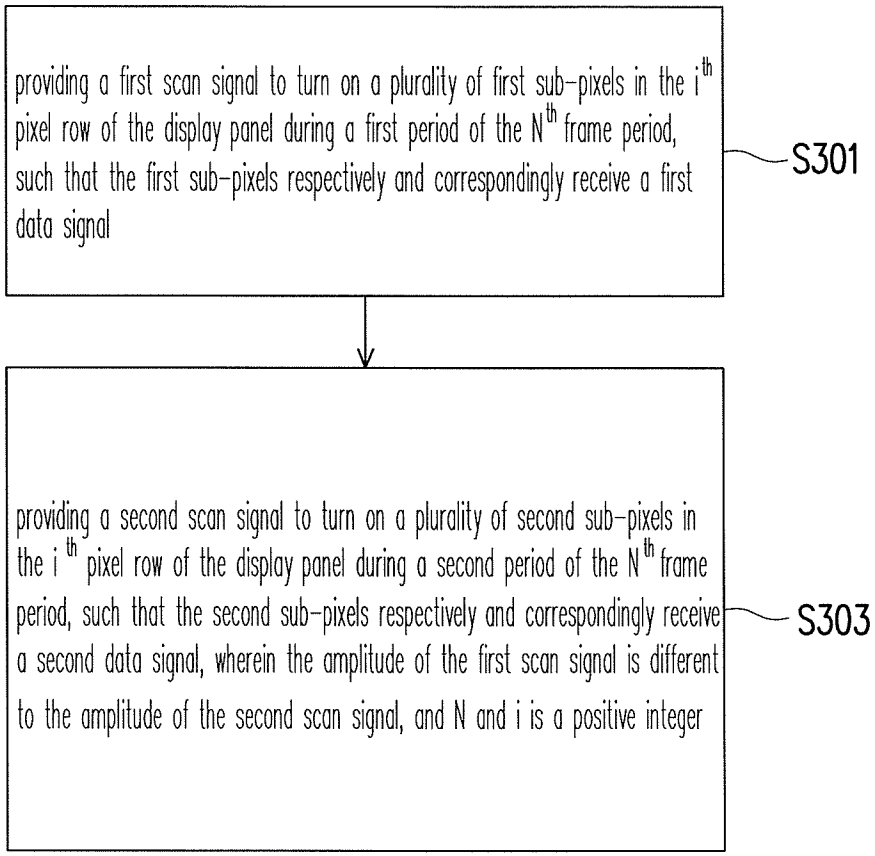
FIG. 3 is a flow chart of a driving method for a display panel according to an embodiment of the present invention.

FIG. 3 is a flow chart of a driving method for a display panel according to an embodiment of the present invention. Referring to FIG. 2 and FIG. 3, the driving method includes the following steps. In step S301, providing a first scan signal to turn on a plurality of first sub-pixels in an $i^{th}$ pixel row of the display panel 201 during a first period of an $N^{th}$ frame period, such that the first sub-pixels respectively and correspondingly receive a first data signal.

Next, in step S303, providing a second scan signal to turn on a plurality of second sub-pixels in the $i^{th}$ pixel row of the display panel 201 during a second period of the $N^{th}$ frame period, such that the second sub-pixels respectively and correspondingly receive a second data signal. The amplitude of the first scan signal is different from the amplitude of the second scan signal, and N and i are a positive integer.

For easily explaining the present invention, suppose the resolution of the display panel 201 in the present embodiment is m*n, and the driving manner of the display panel 201 adopts normally white, AC common voltage and row inversion, but not limited thereto, such driving manner would cause the luminance of all even pixels in each pixel row of the display panel 201 is higher than the luminance of all odd pixels thereof.

Figure 4A:
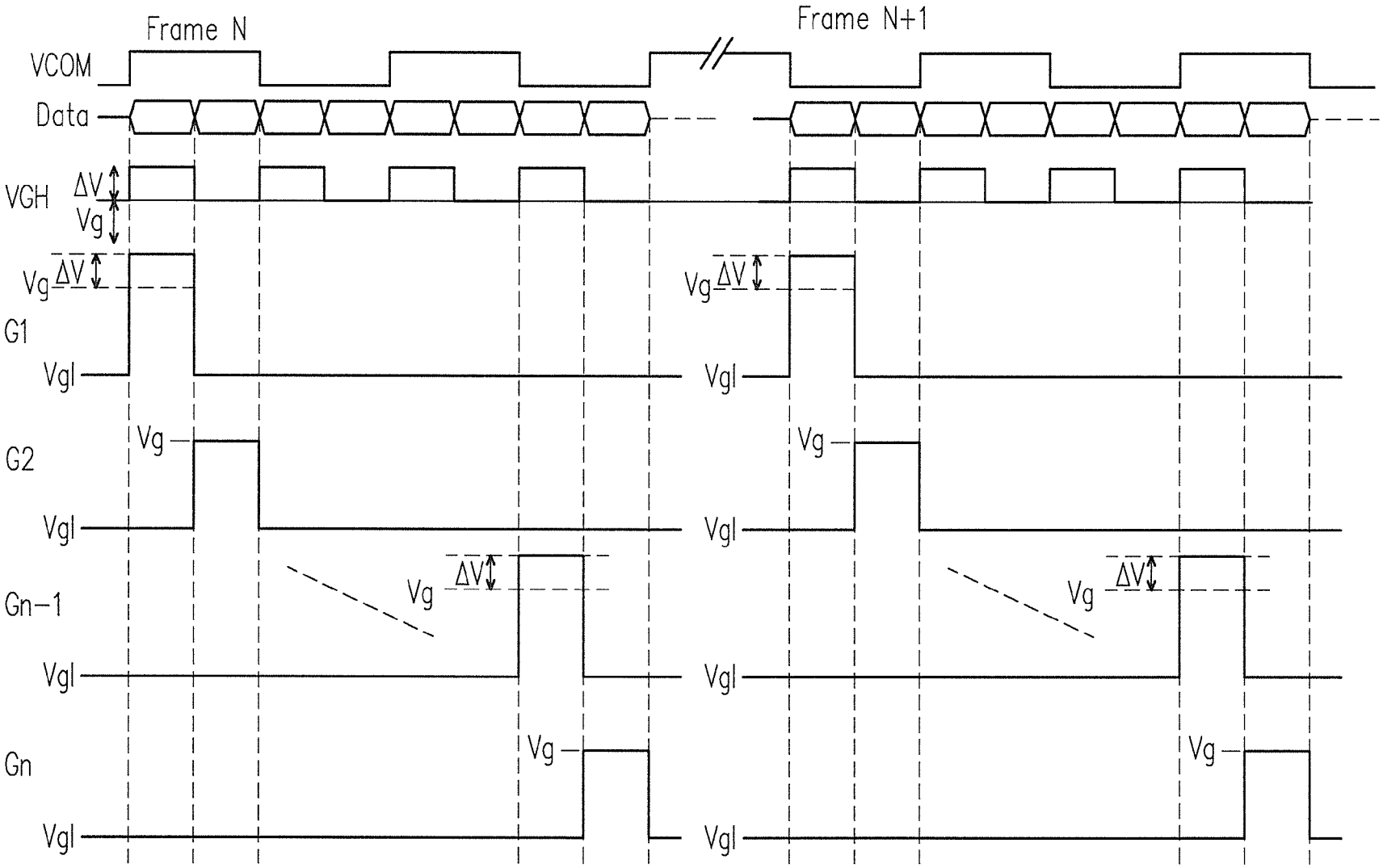
FIG. 4A through FIG. 4L respectively show a diagram of a part of driving signals of a display panel according to an embodiment of the present invention.

According to an embodiment of the present invention, the gate driver 203 would provide the scan signals with bigger amplitude (i.e. in FIG. 4A, the marks G1, G3, . . . , Gn-1 which voltage difference between the gate turn-on voltage VGH and the gate turn-off voltage Vg1 is bigger) to the scan lines turning on odd pixels in each pixel row, and provide the scan signals with smaller amplitude (i.e. in FIG. 4A, the marks G2, G4, . . . , Gn which voltage difference between the gate turn-on voltage VGH and the gate turn-off voltage Vg1 is smaller) to the scan lines turning on even pixels in each pixel row during each frame period, such that the odd pixels and the even pixels in each pixel row would respectively and correspondingly receive the data signals Data.

In the present embodiment, the voltage difference between the scan signals G1, G3, . . . , Gn-1 with bigger amplitude and the scan signals G2, G4, . . . , Gn with smaller amplitude is ΔV. The voltage of the ΔV, for example, is a voltage deviation/shift value caused by the feed-through effect caused between the parasitic capacitors of each of pixels in the pixel array. Accordingly, it could be equivalent to compensate pixels on space axis by regulating the amplitude of the scan signals, so as to helpfully eliminate the feed-through effect caused between the parasitic capacitors of each of pixels in the pixel array. Therefore, the images displayed on the display panel 201 would not produce the vertical blur phenomenon, so that the display quality of the display panel 201 could be substantially promoted.

Figure 4B:
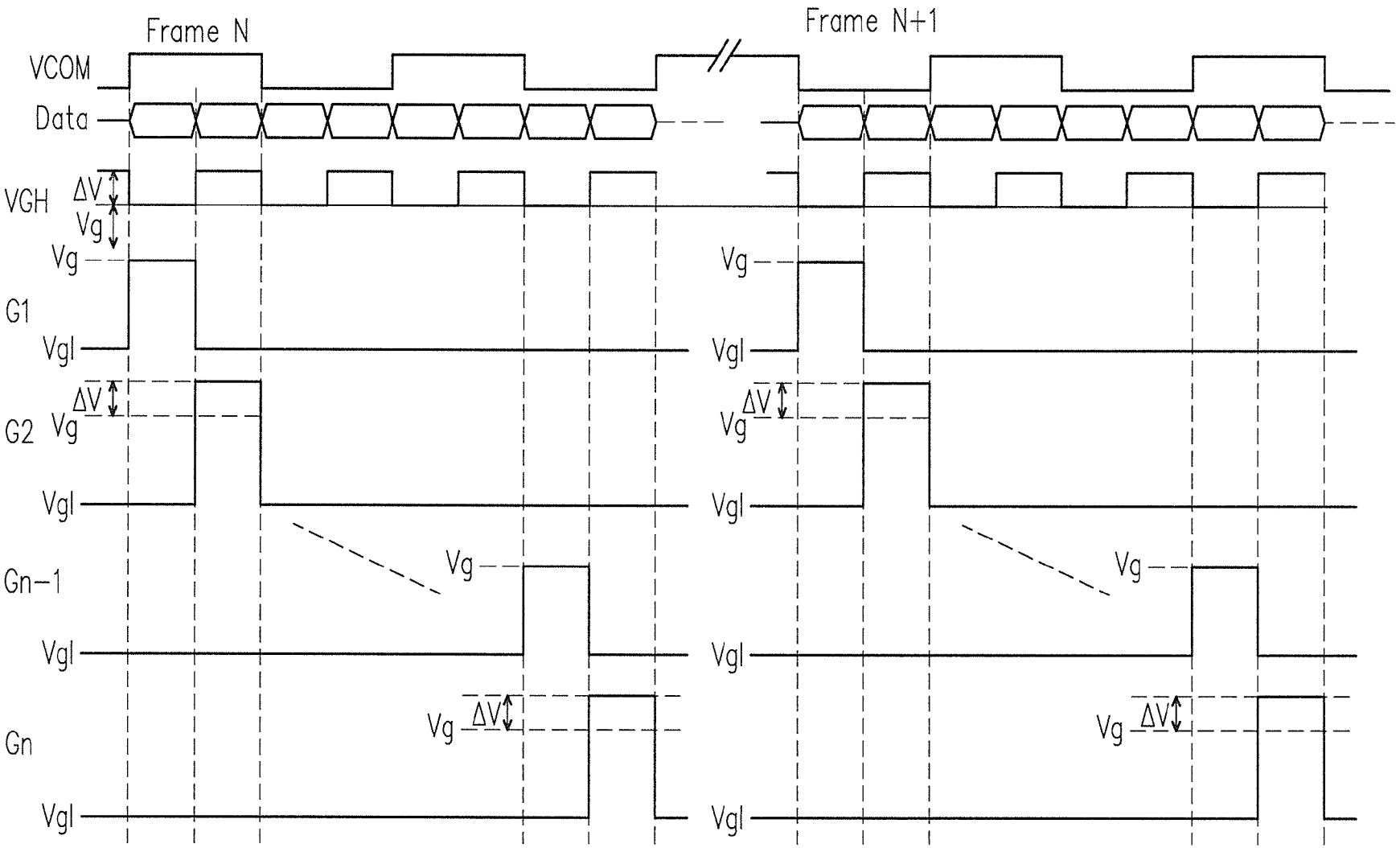

According to an another embodiment of the present invention, the gate driver 203 would provide the scan signals with smaller amplitude (i.e. in FIG. 4B, the marks G1, G3, . . . , Gn-1) to the scan lines turning on odd pixels in each pixel row, and provide the scan signals with bigger amplitude (i.e. in FIG. 4B, the marks G2, G4, Gn) to the scan lines turning on even pixels in each pixel row during each frame period, such that the odd pixels and the even pixels in each pixel row would respectively and correspondingly receive the data signals Data.

In the present embodiment, the voltage difference between the scan signals G1, G3, . . . , Gn-1 with smaller amplitude and the scan signals G2, G4, . . . , Gn with bigger amplitude is ΔV. The voltage of the ΔV, for example, is a voltage deviation/shift value caused by the feed-through effect caused between the parasitic capacitors of each of pixels in the pixel array. Accordingly, it could be equivalent to compensate pixels on space axis by regulating the amplitude of the scan signals, so as to helpfully eliminate the feed-through effect caused between the parasitic capacitors of each of pixels in the pixel array. Therefore, the images displayed on the display panel 201 would not produce the vertical blur phenomenon, so that the display quality of the display panel 201 could be substantially promoted.

Figure 4C:
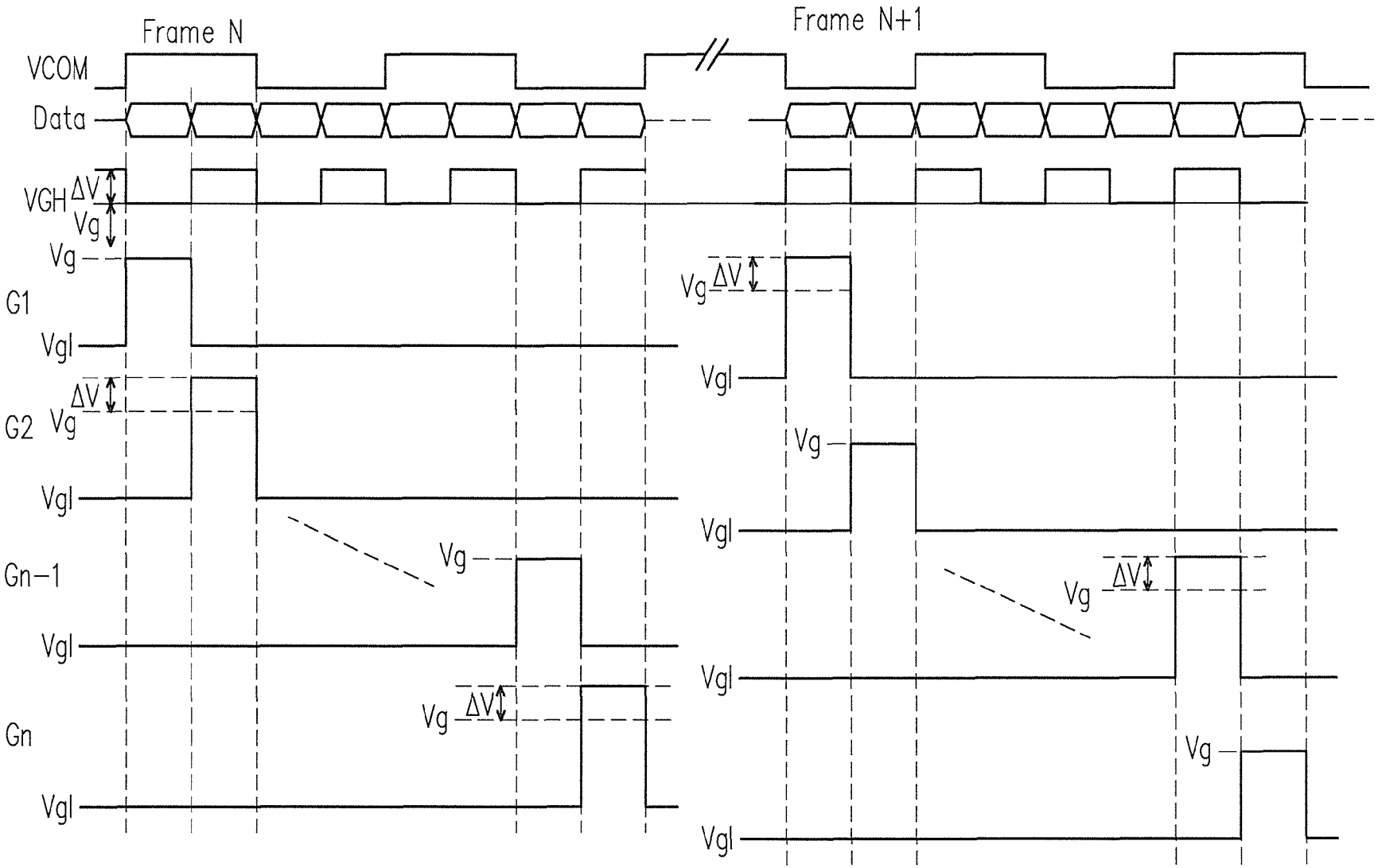

In other embodiments of the present invention, such as shown in FIG. 4C, the gate driver 203 would provide the scan signals with smaller amplitude to the scan lines turning on odd pixels in each pixel row, and provide the scan signals with bigger amplitude to the scan lines turning on even pixels in each pixel row during the $N^{th}$ frame period, but the gate driver 203 would provide the scan signals with bigger amplitude to the scan lines turning on odd pixels in each pixel row, and provide the scan signals with smaller amplitude to the scan lines turning on even pixels in each pixel row during the $(N+1)^{th}$ frame period.

Figure 4D:
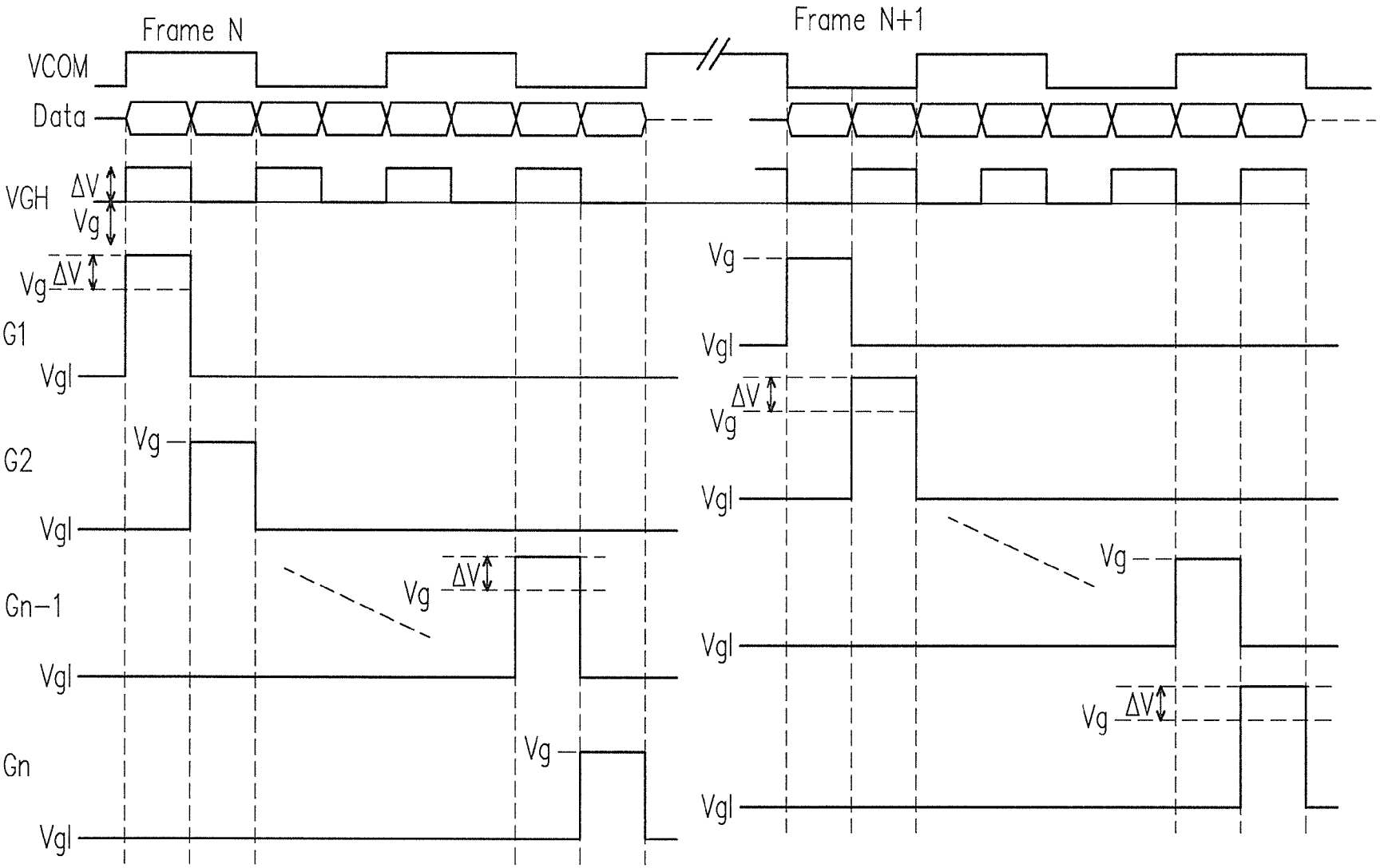
Figure 4E:
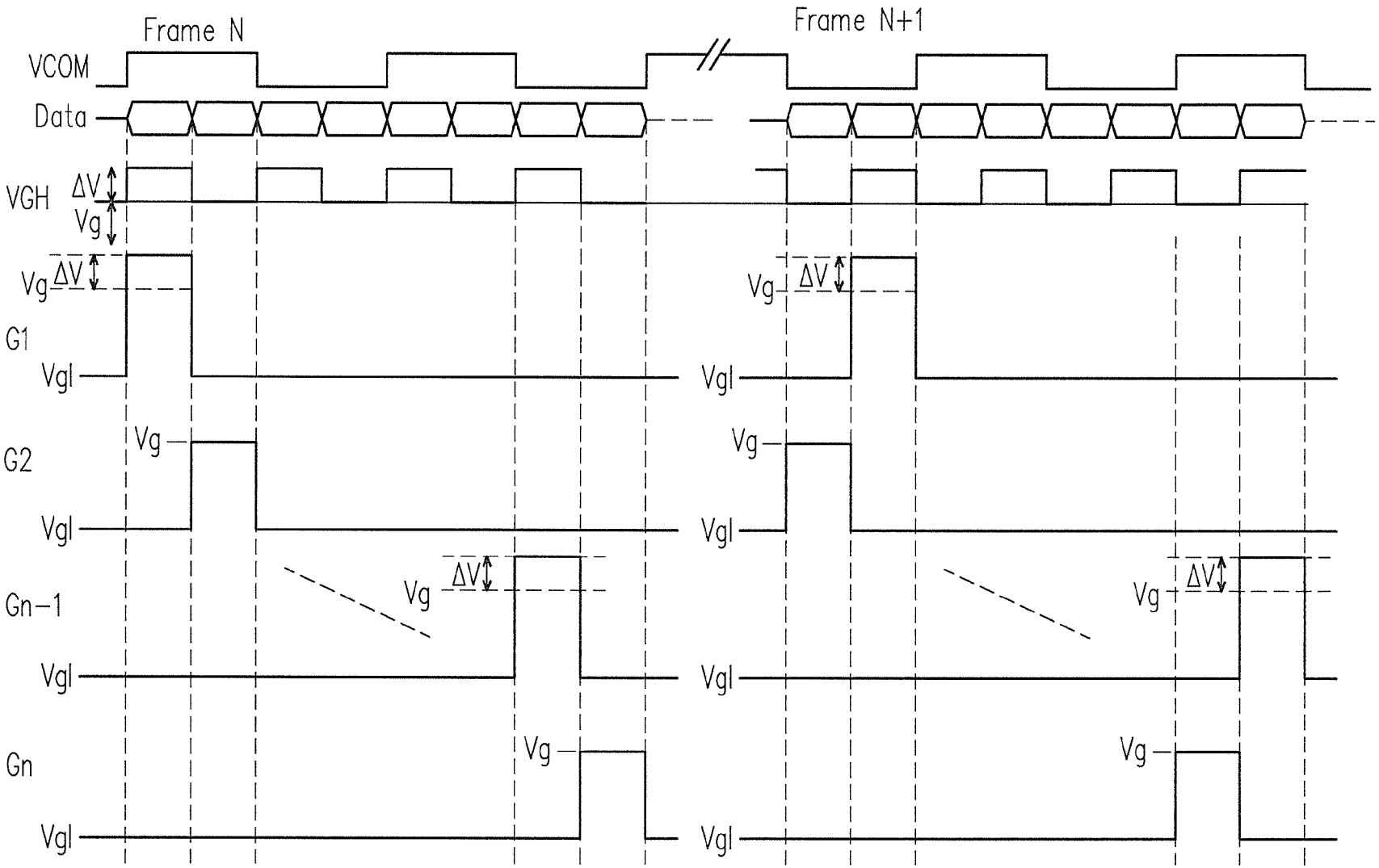
Figure 4F:
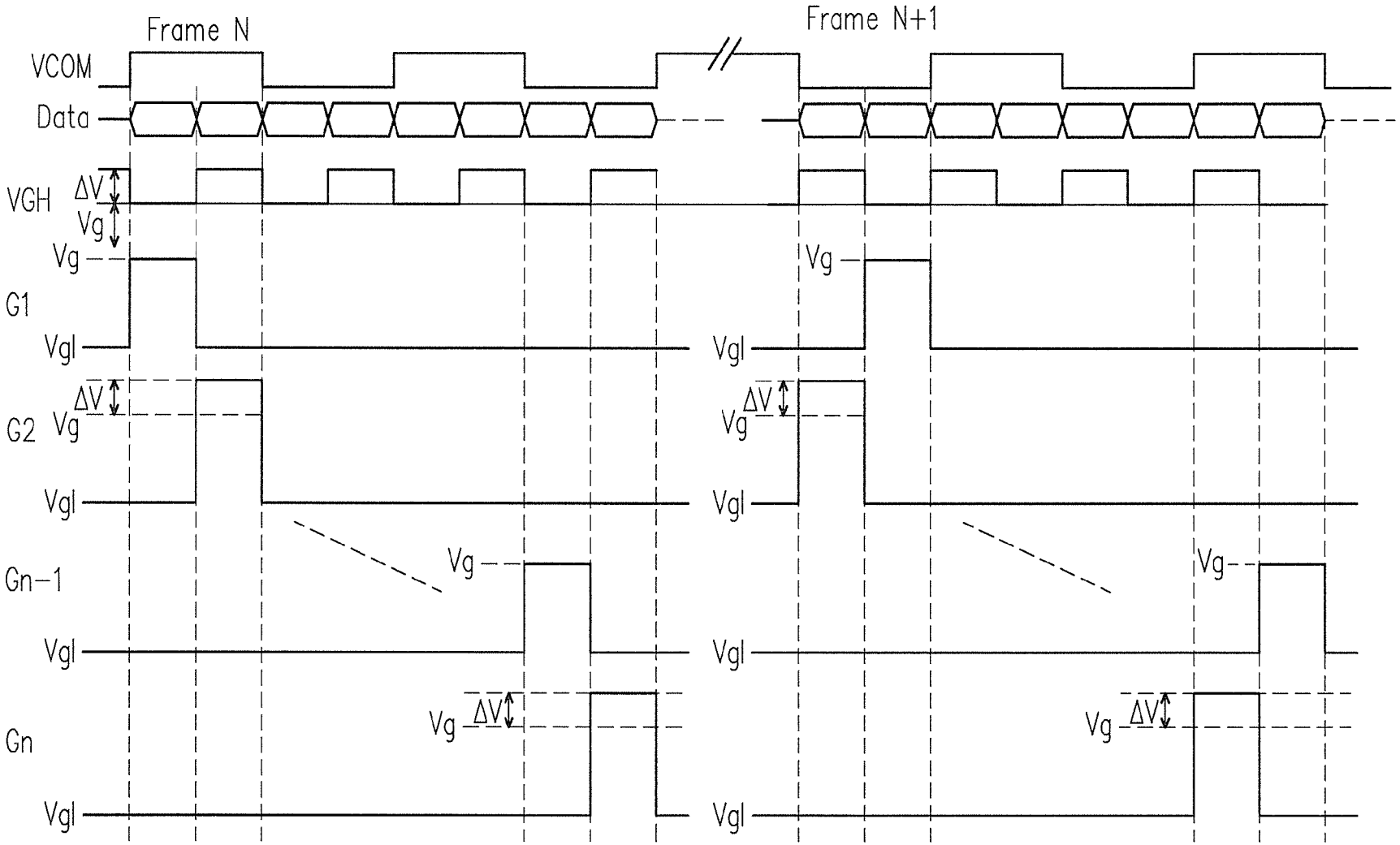
Figure 4G:
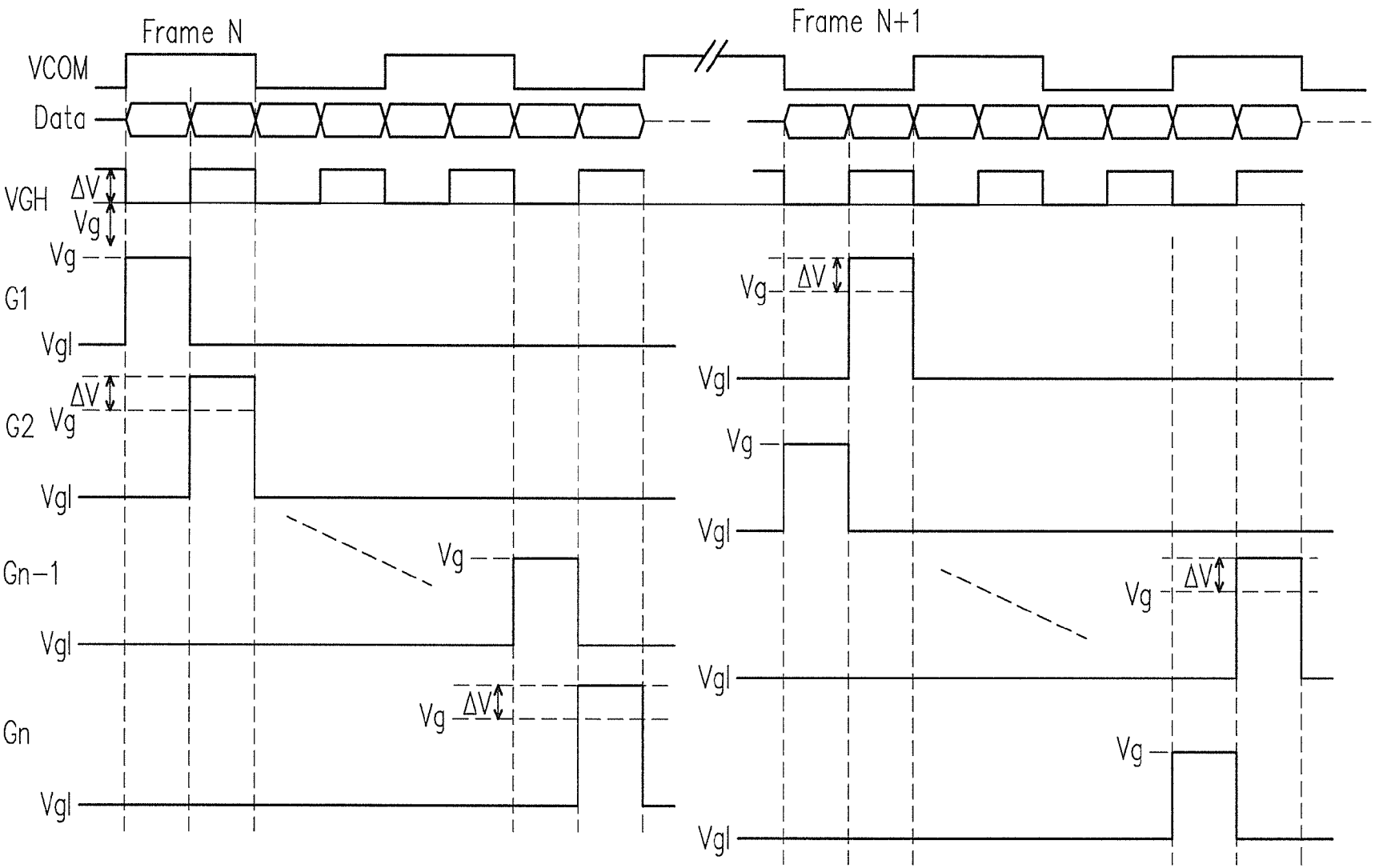
Figure 4H:
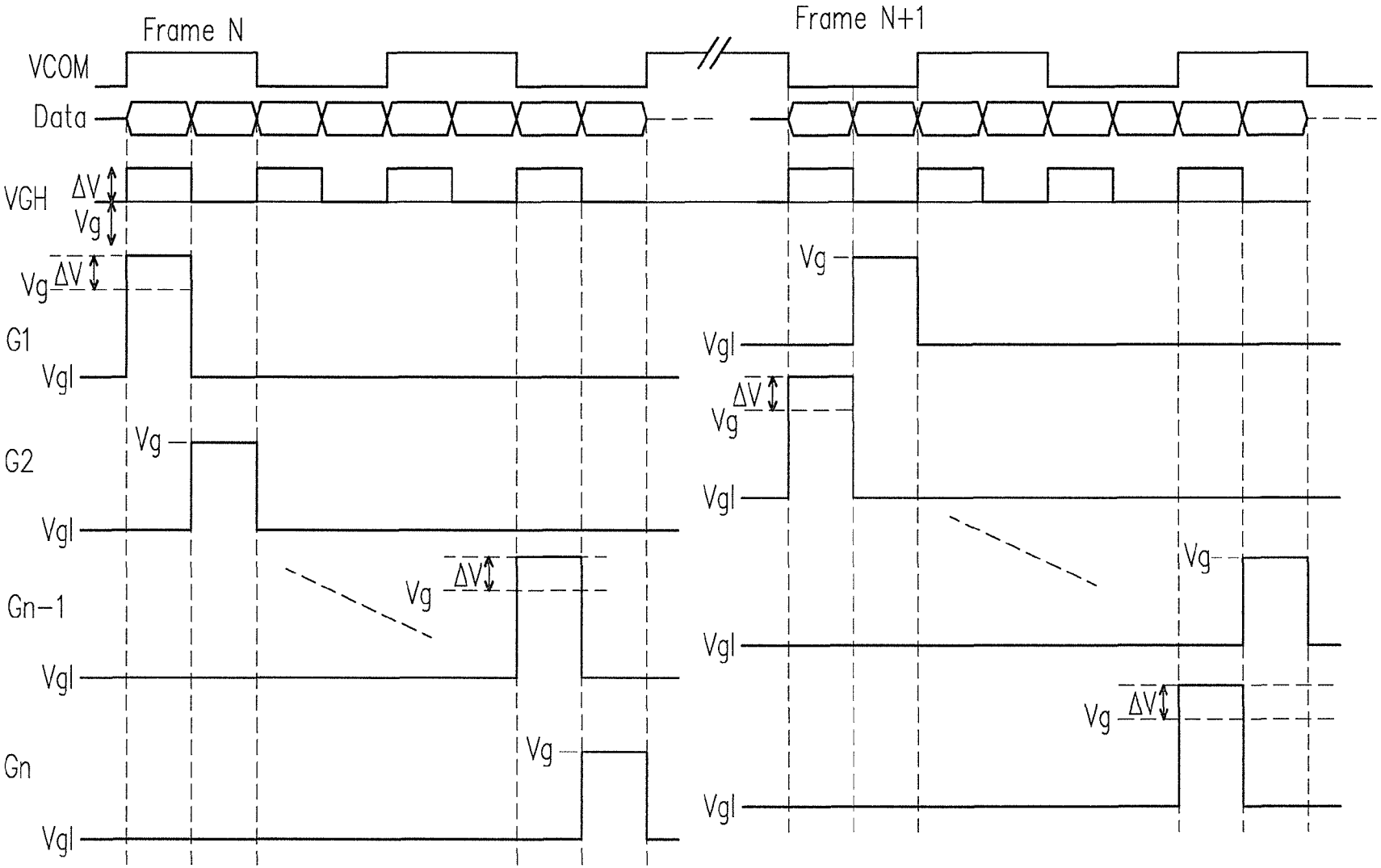

Besides, as shown in FIG. 4D, the gate driver 203 would provide the scan signals with bigger amplitude to the scan lines turning on odd pixels in each pixel row, and provide the scan signals with smaller amplitude to the scan lines turning on even pixels in each pixel row during the $N^{th}$ frame period, but the gate driver 203 would provide the scan signals with smaller amplitude to the scan lines turning on odd pixels in each pixel row, and provide the scan signals with bigger amplitude to the scan lines turning on even pixels in each pixel row during the $(N+1)^{th}$ frame period.

From the above, by which not fixedly providing the scan signals with smaller or bigger amplitude to the scan lines turning on odd or even pixels in each pixel row during each frame period, it also can substantially promote the display quality of the display panel 201.

In accordance with the above embodiments, the above embodiments would fixedly and firstly turn on odd pixels in each pixel row, and afterward turn on even pixels in each pixel row during each frame period. However, in the other embodiments of the present invention, such as shown in FIG. 4E through FIG. 4H, odd pixels in each pixel row could be fixedly and firstly turned on, and even pixels in each pixel row could be afterward turned on during the $N^{th}$ frame period, but even pixels in each pixel row could be fixedly and firstly turned on, and odd pixels in each pixel row could be afterward turned on during the $(N+1)^{th}$ frame period.

Accordingly, it could be equivalent to compensate pixels on space axis and time axis at the same time, so as to further helpfully eliminate the feed-through effect caused between the parasitic capacitors of each of pixels in the pixel array. Therefore, the images displayed on the display panel 201 would not further produce the vertical blur phenomenon, so that the display quality of the display panel 201 could be further substantially promoted.

In an another embodiment of the present invention, the driving method further includes providing a third scan signal to turn on a plurality of third sub-pixels in an $(i+1)^{th}$ pixel row of the display panel 201 during a third period of the $N^{th}$ frame period, such that the third sub-pixels respectively and correspondingly receive a third data signal; and providing a fourth scan signal to turn on a plurality of fourth sub-pixels in the $(i+1)^{th}$ pixel row of the display panel 201 during a fourth period of the $N^{th}$ frame period, such that the fourth sub-pixels respectively and correspondingly receive a fourth data signal. The amplitude of the fourth scan signal is the same as the amplitude of the first scan signal, and the amplitude of the third scan signal is the same as the amplitude of the second scan signal.

Figure 4I:
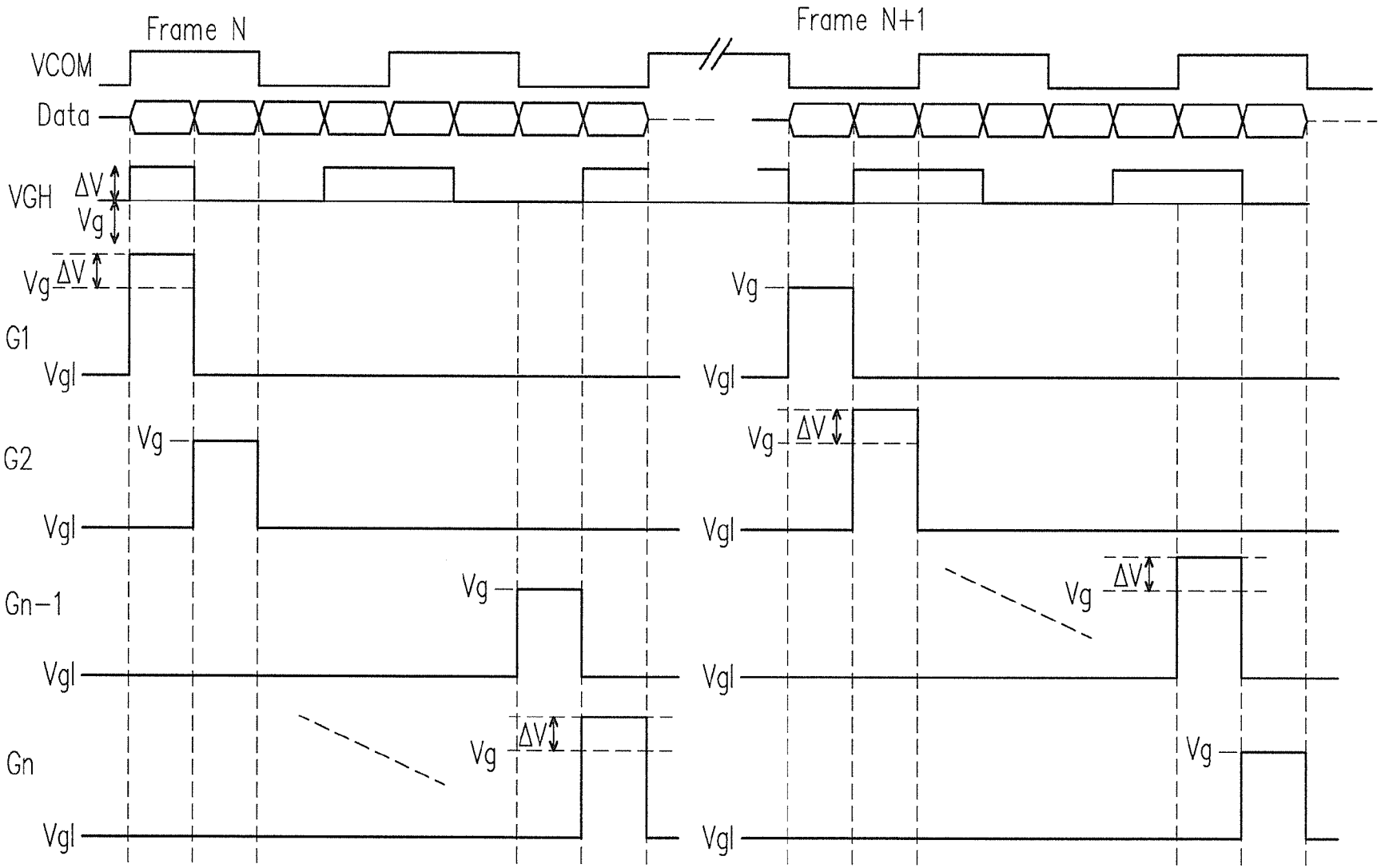

Accordingly, in the another embodiment of the present invention, such as shown in FIG. 4I, during the $N^{th}$ frame period, the gate driver 203 would provide the scan signals with bigger amplitude to the scan lines turning on odd pixels in the $(4k+1)^{th}$ pixel row (k is a natural number which is greater than or equal to 0) and the scan lines turning on even pixels in the $(4k+4)^{th}$ pixel row, namely, G1, G4, G5, G8, G9, G12, . . . , Gn, and provide the scan signals with smaller amplitude to the scan lines turning on even pixels in the $(4k+2)^{th}$ pixel row and the scan lines turning on odd pixels in the $(4k+3)^{th}$ pixel row, namely, G2, G3, G6, G7, G10, G11, . . . , Gn-1.

However, during the $(N+1)^{th}$ frame period, the gate driver 203 would provide the scan signals with bigger amplitude to the scan lines turning on even pixels in the $(4k+2)^{th}$ pixel row and the scan lines turning on odd pixels in the $(4k+3)^{th}$ pixel row, namely, G2, G3, G6, G7, G10, G11, . . . , Gn-1, and provide the scan signals with smaller amplitude to the scan lines turning on odd pixels in the $(4k+1)^{th}$ pixel row and the scan lines turning on even pixels in the $(4k+4)^{th}$ pixel row, namely, G1, G4, G5, G8, G9, G12, . . . , Gn, such that the odd pixels and the even pixels in each pixel row would respectively and correspondingly receive the data signals Data.

Figure 4J:
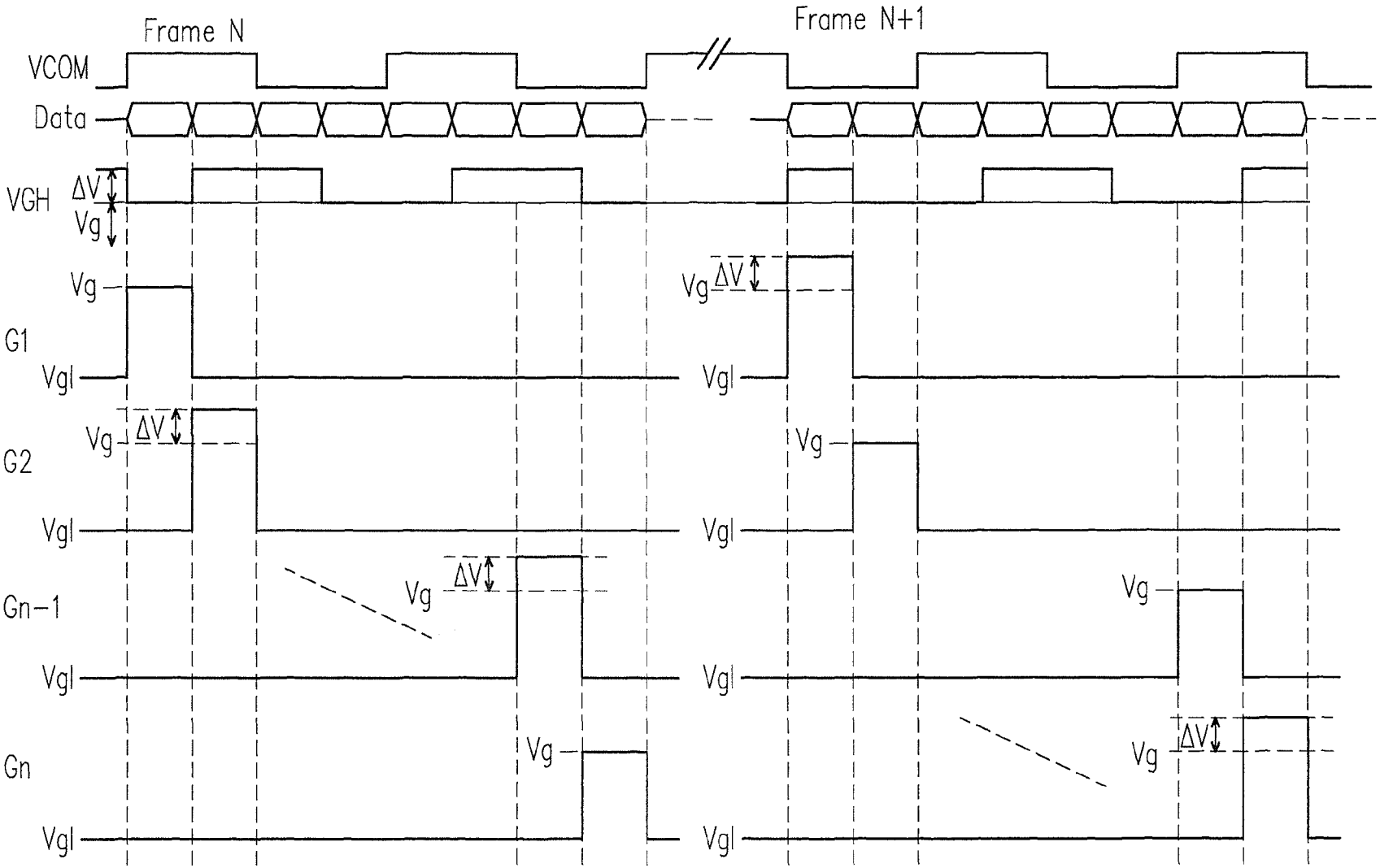

Besides, in an another embodiment of the present invention, such as shown in FIG. 4J, during the $N^{th}$ frame period, the gate driver 203 would provide the scan signals with smaller amplitude to the scan lines turning on odd pixels in the $(4k+1)^{th}$ pixel row and the scan lines turning on even pixels in the $(4k+4)^{th}$ pixel row, namely, G1, G4, G5, G8, G9, G12, . . . , Gn, and provide the scan signals with bigger amplitude to the scan lines turning on even pixels in the $(4k+2)^{th}$ pixel row and the scan lines turning on odd pixels in the $(4k+3)^{th}$ pixel row, namely, G2, G3, G6, G7, G10, G11, . . . , Gn-1.

However, during the $(N+1)^{th}$ frame period, the gate driver 203 would provide the scan signals with smaller amplitude to the scan lines turning on even pixels in the $(4k+2)^{th}$ pixel row and the scan lines turning on odd pixels in the $(4k+3)^{th}$ pixel row, namely, G2, G3, G6, G7, G10, G11, . . . , Gn-1, and provide the scan signals with bigger amplitude to the scan lines turning on odd pixels in the $(4k+1)^{th}$ pixel row and the scan lines turning on even pixels in the $(4k+4)^{th}$ pixel row, namely, G1, G4, G5, G8, G9, G12, . . . , Gn, such that the odd pixels and the even pixels in each pixel row would respectively and correspondingly receive the data signals Data.

In the embodiments as shown in FIG. 41 and FIG. 4J, the voltage difference between the scan signals with smaller amplitude and the scan signals with bigger amplitude is ΔV. The voltage of the ΔV, for example, is a voltage deviation/shift value caused by the feed-through effect caused between the parasitic capacitors of each of pixels in the pixel array. Accordingly, it could be equivalent to compensate pixels on space axis by regulating the amplitude of the scan signals, so as to helpfully eliminate the feed-through effect caused between the parasitic capacitors of each of pixels in the pixel array. Therefore, the images displayed on the display panel 201 would not produce the vertical blur phenomenon, so that the display quality of the display panel 201 could be substantially promoted.

Figure 4K:
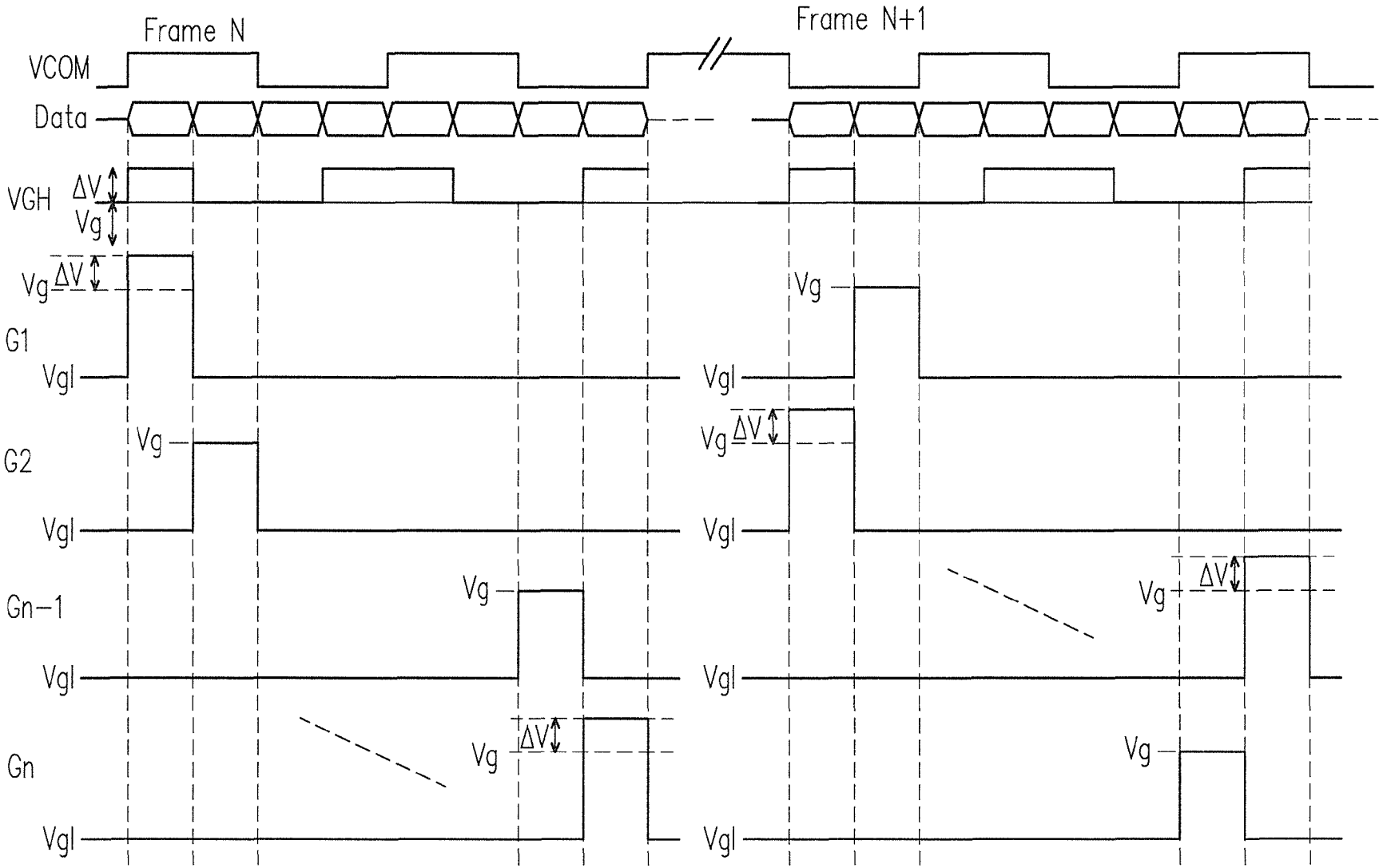
Figure 4L:
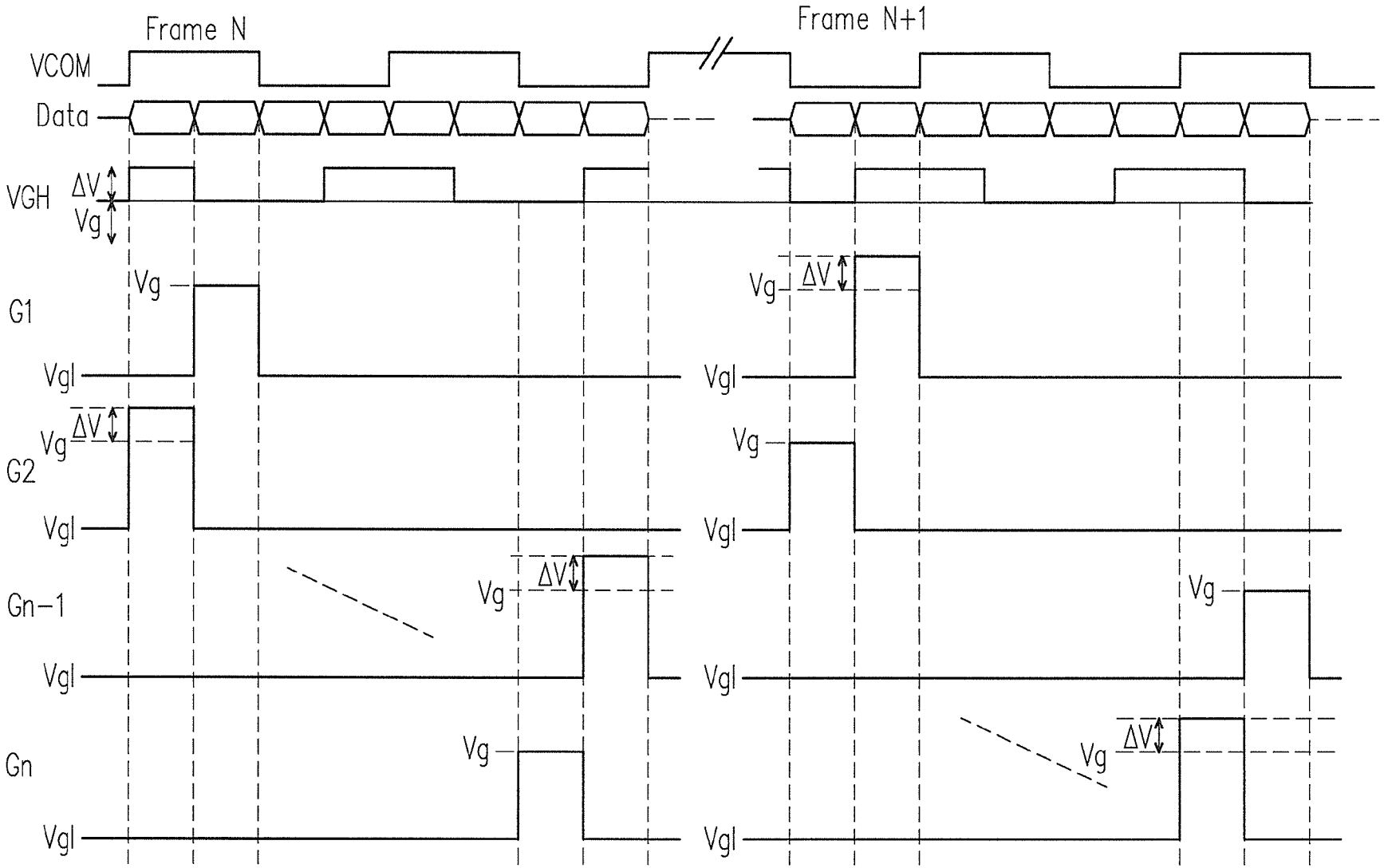

In other embodiments of the present invention, such as shown in FIG. 4K and FIG. 4L, odd pixels in each pixel row could be fixedly and firstly turned on, and even pixels in each pixel row could be afterward turned on during the $N^{th}$ frame period, but even pixels in each pixel row could be fixedly and firstly turned on, and odd pixels in each pixel row could be afterward turned on during the $(N+1)^{th}$ frame period.

Accordingly, it could be equivalent to compensate pixels on space axis and time axis at the same time, so as to further helpfully eliminate the feed-through effect caused between the parasitic capacitors of each of pixels in the pixel array. Therefore, the images displayed on the display panel 201 would not further produce the vertical blur phenomenon, so that the display quality of the display panel 201 could be further substantially promoted.

In summary, the driving method of the present invention provides the scan signals with different amplitude to the corresponding pixel row of the display panel, so as to improve the problem of images producing non-uniform luminance caused by the vertical blur phenomenon, and substantially promoting the display quality of the display panel. In addition, if any technologies by which providing the scan signals with different amplitude to the corresponding pixel row of the display panel so as to improve/resolve/restrain the problem of images producing non-uniform luminance caused by the vertical blur phenomenon would fall in the scope of the present invention.

It will be apparent to those skills in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A driving method for a display panel of an LCD, the method comprising:

providing a first scan signal to turn on a plurality of first sub-pixels in an $i^{th}$ pixel row of the display panel during a first period of an $N^{th}$ frame period of the LCD, such that the first sub-pixels respectively and correspondingly receive a first data signal;

providing a second scan signal to turn on a plurality of second sub-pixels in the $i^{th}$ pixel row of the display panel during a second period of the $N^{th}$ frame period of the LCD, in which the second period of the $N^{th}$ frame period is after and immediately follows the first period of the $N^{th}$ frame period, such that the second sub-pixels respectively and correspondingly receive a second data signal;

providing a third scan signal to turn on a plurality of third sub-pixels in an $(i+1)^{th}$ pixel row of the display panel during a third period of the $N^{th}$ frame period, in which the third period of the $N^{th}$ frame period is after the second period of the $N^{th}$ frame period, such that the third sub-pixels respectively and correspondingly receive a third data signal; and providing a fourth scan signal to turn on a plurality of fourth sub-pixels in the $(i+1)^{th}$ pixel row of the display panel during a fourth period of the $N^{th}$ frame period, in which the fourth period of the $N^{th}$ frame period is after the third period of the $N^{th}$ frame period, such that the fourth sub-pixels respectively and correspondingly receive a fourth data signal;

wherein an amplitude of the first scan signal is different from an amplitude of the second scan signal, and N and i are positive integers, wherein the first scan signal and the second scan signal are respectively enabled only once and sequentially provided during the $N^{th}$ frame period, such that only the first sub-pixels in the $i^{th}$ pixel row are turned on during the first period of the $N^{th}$ frame period, and only the second sub-pixels in the $i^{th}$ pixel row are turned on during the second period of the $N^{th}$ frame period, wherein an amplitude of the fourth scan signal is the same as the amplitude of the first scan signal, and an amplitude of the third scan signal is the same as the amplitude of the second scan signal, wherein the third scan signal and the fourth scan signal are respectively enabled only once during the $N^{th}$ frame period, and the first to the fourth are sequentially provided during the $N^{th}$ frame period, wherein only the third sub-pixels in the $(i+1)^{th}$ pixel row are turned on during the third period of the $N^{th}$ frame period, and only the fourth sub-pixels in the $(i+1)^{th}$ pixel row are turned on during the fourth period of the $N^{th}$ frame period.

2. The driving method according to claim 1, further comprising:

providing the second scan signal to turn on the second sub-pixels during the first period of an $(N+1)^{th}$ frame period of the LCD, such that the second sub-pixels respectively and correspondingly receive the second data signal; and providing the first scan signal to turn on the first sub-pixels during the second period of the $(N+1)^{th}$ frame period, such that the first sub-pixels respectively and correspondingly receive the first data signal, wherein the first scan signal and the second scan signal are respectively enabled only once and sequentially provided during the $(N+1)^{th}$ frame period.

3. The driving method according to claim 2, wherein the amplitude of the first scan signal at the first period of the $N^{th}$ and the $(N+1)^{th}$ frame periods is greater than the amplitude of the second scan signal at the second period of the $N^{th}$ and the $(N+1)^{th}$ frame periods.

4. The driving method according to claim 2, wherein the amplitude of the second scan signal at the second period of the $N^{th}$ and the $(N+1)^{th}$ frame periods is greater than the amplitude of the first scan signal at the first period of the $N^{th}$ and the $(N+1)^{th}$ frame periods.

5. The driving method according to claim 2, wherein the amplitude of the first scan signal at the first period of the $N^{th}$ frame period is greater than the amplitude of the second scan signal at the second period of the $N^{th}$ frame period, and the amplitude of the second scan signal at the second period of the $(N+1)^{th}$ frame period is greater than the amplitude of the first scan signal at the first period of the $(N+1)^{th}$ frame period.

6. The driving method according to claim 2, wherein the amplitude of the second scan signal at the second period of the $N^{th}$ frame period is greater than the amplitude of the first scan signal at the first period of the $N^{th}$ frame period, and the amplitude of the first scan signal at the first period of the $(N+1)^{th}$ frame period is greater than the amplitude of the second scan signal at the second period of the $(N+1)^{th}$ frame period.

7. The driving method according to claim 1, further comprising:

providing the second scan signal to turn on the second sub-pixels during the first period of an $(N+1)^{th}$ frame period of the LCD, such that the second sub-pixels respectively and correspondingly receive the second data signal;

providing the first scan signal to turn on the first sub-pixels during the second period of the $(N+1)^{th}$ frame period, such that the first sub-pixels respectively and correspondingly receive the first data signal;

providing the fourth scan signal to turn on the fourth sub-pixels during the third period of the $(N+1)^{th}$ frame period, such that the fourth sub-pixels respectively and correspondingly receive the fourth data signal; and providing the third scan signal to turn on the third sub-pixels during the fourth period of the $(N+1)^{th}$ frame period, such that the third sub-pixels respectively and correspondingly receive the third data signal, wherein the second, the first, the fourth and the third scan signals are respectively enabled only once and sequentially provided during the $(N+1)^{th}$ , frame period.

8. The driving method according to claim 7, wherein the amplitudes of the first and the fourth scan signals at the first and the fourth periods of the $N^{th}$ frame period, respectively, are greater than the amplitudes of the second and the third scan signals at the second and the third periods of the $N^{th}$ frame period, respectively, and the amplitudes of the second and the third scan signals at the second and the third periods of the $(N+1)^{th}$ frame period, respectively, are greater than the amplitudes of the first and the fourth scan signals at the first and the fourth periods of the $(N+1)^{th}$ frame period, respectively.

9. The driving method according to claim 7, wherein the amplitudes of the second and the third scan signals at the second and the third periods of the $N^{th}$ frame period, respectively, are greater than the amplitudes of the first and the fourth scan signals at the first and the fourth periods of the $N^{th}$ frame period, respectively, and the amplitudes of the first and the fourth scan signals at the first and the fourth periods of the $(N+1)^{th}$ frame period, respectively, are greater than the amplitudes of the second and the third scan signals at the second and the third periods of the $(N+1)^{th}$ frame period, respectively.

* * * * *